US006908513B2

(12) United States Patent
Henke

(10) Patent No.: US 6,908,513 B2
(45) Date of Patent: Jun. 21, 2005

(54) DEVICE FOR APPLYING AN ADHESIVE TO THE SPINE OF AN INNER BOOK OR TO AREAS OF THE LATERAL FACES ADJACENT THERETO

(75) Inventor: Jens Henke, Melle (DE)

(73) Assignee: Kolbus GmbH & Co. KG, Rahden (DE)

( * ) Notice: Subject to any disclaimer, the term of this patent is extended or adjusted under 35 U.S.C. 154(b) by 32 days.

(21) Appl. No.: 10/660,279

(22) Filed: Sep. 11, 2003

(65) Prior Publication Data

US 2004/0129206 A1 Jul. 8, 2004

(30) Foreign Application Priority Data

Sep. 12, 2002 (DE) ..... 102 42 260

(51) Int. Cl.[7] ..... B05C 1/02

(52) U.S. Cl. ..... 118/681; 118/262; 156/578; 156/908; 412/37

(58) Field of Search ..... 118/681, 227, 118/244, 262; 156/578, 908; 412/8, 37, 33

(56) References Cited

U.S. PATENT DOCUMENTS 5,129,772 A * 7/1992 Slautterback ..... 412/8

FOREIGN PATENT DOCUMENTS

| | | | |
|---|---|---|---|
| DE | 3610413 | A1 | 3/1986 |
| DE | 3625457 | A1 | 7/1986 |
| DE | 200 08 757 | U1 | 9/2000 |
| EP | 12 08 998 | A1 | 11/2000 |
| JP | 09086070 | A | 3/1997 |

* cited by examiner

*Primary Examiner*—Laura Edwards
(74) *Attorney, Agent, or Firm*—Alix, Yale & Ristas, LLP

(57) ABSTRACT

In a device (1, 51) for applying an adhesive to the spine (2*a*) or to areas (2*b*) of the lateral faces adjacent thereto of an inner book (2) having a projecting portion and conveyed past in a transport system (3), comprising at least one rotating application roller (53*a,b*) or application disc (5) which picks up the adhesive from a reservoir (4, 52) and transfers same to the inner book (2) by rolling-off, the device having a doctor blade (7, 54*a,b*) adjustable with regard to its distance from the application roller (5, 53*a,b*) for regulating the application thickness of the adhesive and having an actuating device (8, 9, 57, 59) for the controlled movement of the doctor blade (7, 54*a,b*) between an application and a zero-application position, it is provided that the actuating device includes at least one single-acting contraction hose (24*a,b*, 56*a,b*) controllable via compressed air (P) and acting as a pull actuator.

20 Claims, 4 Drawing Sheets

DEVICE FOR APPLYING AN ADHESIVE TO THE SPINE OF AN INNER BOOK OR TO AREAS OF THE LATERAL FACES ADJACENT THERETO

BACKGROUND OF THE INVENTION

The present invention relates to a device for applying an adhesive to the spine region of an inner book that projects from a clamp or the like as the book is conveyed in a transport system.

Devices of this type include at least one rotating application roller or application disc which picks up adhesive from a reservoir and transfers the adhesive to the inner book by rolling-off, a doctor blade adjustable relative to the application roller for regulating the application thickness of the adhesive, and an actuating device for the controlled movement of the doctor blade between an application position and a zero-application position.

Various application systems in adhesive binding machines are available for mechanically applying an adhesive to the spine and adjacent areas of the side faces of inner books together or in the alternate also referred to herein as the "spine region". Wheel glue application mechanisms are very often used, wherein the embodiments for spine gluing are referred to as (cylindrical) roller mechanisms, while the embodiments for applying glue to the sides are referred to as discs. Roller gluing mechanisms consist predominantly of a first roller for applying a thin layer of adhesive and a second roller for applying a thick layer of adhesive. For leveling and removing surplus adhesive from the spine of the inner book a spinner roller which rotates in the opposite direction to the transport direction of the inner books is arranged downstream of both the above-mentioned rollers. Doctor blades adjustable with respect to the roller surface are provided for metering the thickness of the adhesive applied to the rollers. A roller gluing mechanism of this kind for spine gluing is schematically represented, for example, in Liebau, Heinze: Industrielle Buchbinderei, Verlag Beruf+Schule, Itzehoe 2001, Ch. 4.2.3.3.6, pp. 284 ff.

A side-gluing mechanism with application discs is described, for example, in DE 200 08 757 U1. The adhesive is located in a reservoir below the transport plane of the inner book and is conveyed upwardly into the gluing area by means of a helical adhesive scraper surrounding the application discs. Here the application thickness of the adhesive is regulated by doctor blades.

The doctor blades are switched or controlled back and forth between an application and a zero-application position synchronously with the inner book conveyance. Application of the adhesive begins when the inner book passes over the rollers or discs and ends before the end of the inner book leaves the approach area of the rollers. This avoids adhesive banked up at the start from depositing on the front face of the inner book and adhesive projecting from the inner book through thread formation at the end. In addition, the adhesive must be applied offset from the beginning and end of the inner book, so that adhesive is not squeezed out when the cover is pressed on. The offset adhesive application also minimises contamination of the trimmed waste with adhesive. For high-quality adhesive binding start and finish points of the glue application positioned precisely at the beginning and end of the inner book are required. The flank at the start and finish of the adhesive layer must be as steep as possible. Especially in the case of adhesive binders with high transit velocities, this necessitates a very fast (dynamic) movement of the doctor blade between the application and zero-application positions.

In the case of known wheel gluing mechanisms the doctor blades are controlled by cams. The start and finish positions for the adhesive layer are embodied in a fixed manner in the cams. To adjust the length and position of the adhesive layer complex designs with variable transmissions are required, or the adjustments can only be carried out with the adhesive binder at a standstill. Layer patterns or the omission of the adhesive layer at the separation point of an inner book manufactured two copies are possible only by replacing the cams by cams specially in configured for this purpose. With pneumatic actuation of the doctor blades the adjustment can be effected electrically and special layer patterns are possible with suitably constructed control devices. For example, a wheel gluing mechanism for side-gluing with pneumatically actuated doctor blades is illustrated in JP 09-086070. However, ordinary pneumatic cylinders have imprecise switching times, making it impossible to apply adhesive precisely, especially at high transit velocities of the inner book. Because of the poor dynamic behaviour of the pneumatic cylinders the start and finish points are not sharply defined.

SUMMARY OF THE INVENTION

It is the object of the present invention to provide a device for applying an adhesive to the spine region of an inner book by means of which, despite simple construction, the doctor blades can be moved rapidly and precisely back and forth between the application and zero-application positions even at high transit velocities of the inner book, to produce an adhesive layer which is precisely positioned with respect to beginning and end of the inner book.

This object is achieved according to the invention in that the actuating device includes at least one contraction hose controllable by compressed air and functioning as a single-acting pull actuator. As compared to conventional pneumatic cylinders the contraction hose does not exhibit slip-stick behaviour and generates high-acceleration movements whereby the start and finish points of the adhesive layer are delineated especially sharply. For a given force the contraction hose has considerably lower energy consumption. It is insensitive to dirt and dust and is therefore especially suitable for use in printed-matter processing machines contaminated with paper dust.

An arrangement effectively connecting the contraction hose to a spring against which the contraction hose works is preferred. In this case it has proved effective for the contraction hose to pull the doctor blade into the application position and for the spring to determine the zero-application position when the contraction hose is switched to be unpressurised. In an alternative embodiment two reciprocally-acting contraction hoses are used. The application and zero-application positions are advantageously defined by stops, the stops at the same time functioning as dampers. A pilot control of the pneumatic valve associated with the contraction hose and dependent on the transit velocity of the inner book, whereby adhesive layers positioned precisely at the beginning and end of the inner book are achievable, is advantageous.

The contraction hose is advantageously controlled by variable pressure, whereby the associated doctor blade is pulled to a position between the zero-application and the application positions corresponding to the pressure, and a specified application thickness of the adhesive can be set. By means of tracing of the relief of the inner book spine and corresponding activation by compressed air, an adhesive layer configured to be complementary to said relief is advantageously applied to the spine.

An actuating device is preferably provided for each doctor blade. Different adhesive layer patterns for the two lateral faces of the inner book can, for example, be produced thereby.

The invention is elucidated in more detail below with reference to the accompanying drawings, in which.

DESCRIPTION OF THE PREFERRED EMBODIMENT

Figure 1:
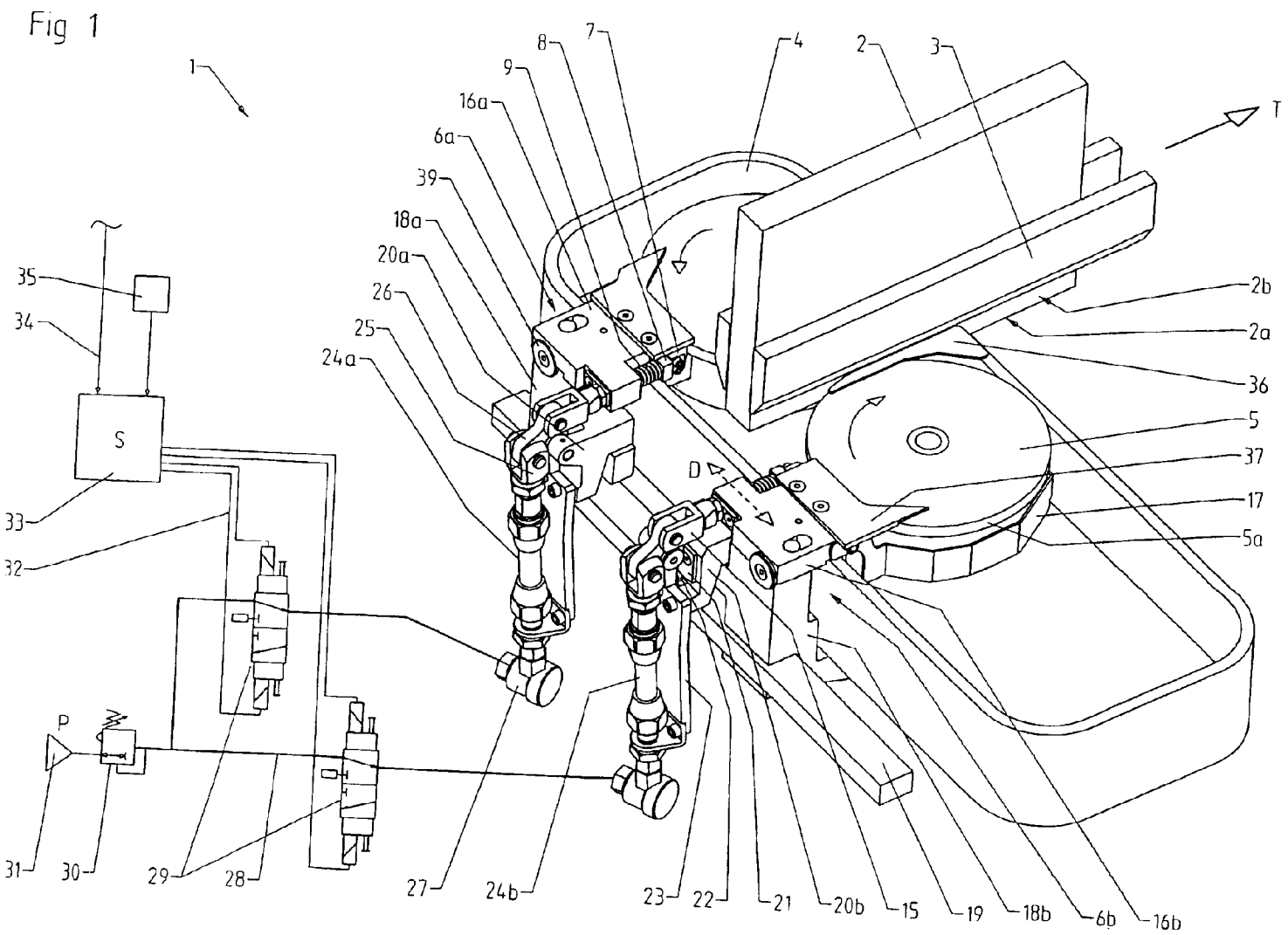
FIG. 1 shows a side-gluing mechanism in a perspective view.
Figure 2:
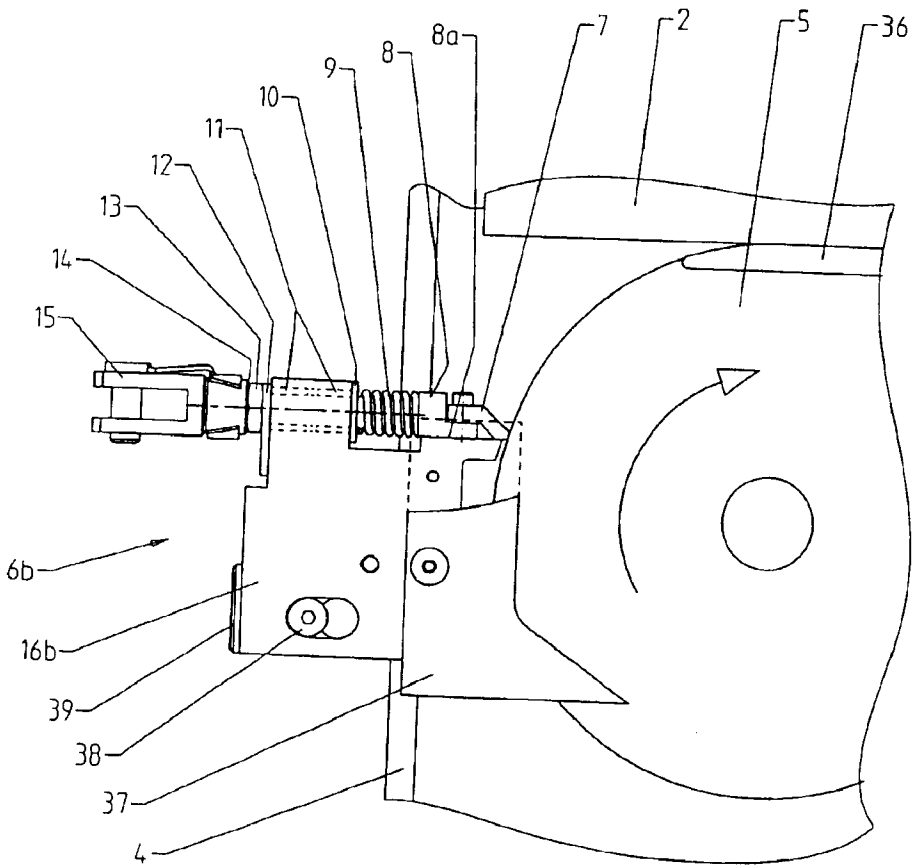
FIG. 2 shows in plan view the right-hand adhesive conveyor of the side-gluing mechanism with the doctor blade guided therein.

The side-gluing mechanism 1 illustrated in FIGS. 1 and 2 serves to apply an adhesive to the lateral or side areas 2*b* adjacent to the spine of an inner book 2 which is held with a hanging-out or projecting portion by an inner book clamp 3 and is transported in transport direction T across the side-gluing mechanism 1 with the inner book spine 2*a* facing downwards. The adhesive is located in a reservoir 4 below the movement path of the inner book 2 and is conveyed upwardly by means of a left-hand and a right-hand adhesive conveyor 6*a,b*. The respective adhesive conveyor 6*a,b* is formed by an application disc 5 rotating in the transport direction T and an adhesive scraper (not illustrated in detail) formed in a block 16*a*, 16*b* respectively and helically surrounding the application disc 5, whereby the adhesive is conducted to the rolling-off area 5*a* of the application disc 5. Here the thickness of the adhesive layer is regulated by doctor blades 7. The adhesive conveyors 6 and associated scrapers in the blocks 16, and the way they helically sorround the disc 5, are conventional, such as described in DE 22 57 614 A1.

By the rolling of the application disc 5 against the inner book 2 in the lateral areas 2*b* adjacent to the spine the adhesive is transferred to the latter. Guide rails 36 serve to guide the inner book 2 so that the outer sheets of the inner book 2 are not pulled outwardly as the application disc 5 moves away from the inner book 2. To control the currents in the reservoir induced by the adhesive conveyor 6*a,b*, guide plates 17 are arranged upstream of the blocks 16*a,b*. Scrapers 37 which close the adhesive conveyors 6*a,b* at the top and scrape the adhesive located on the upper faces of the application discs 5 back into the reservoir 4 are also provided.

The doctor blade 7 is attached exchangeably to one end of a pin 8, which is guided in the respective block 16*a*, 16*b* by means of bushes 11 and a guide face 8*a* on the pin 8. A compression spring 9 which bears against the respective block 16*a*, 16*b* via a washer pushes the doctor blade 7 to the zero-application position. In the latter position the adhesive is scraped completely from the application disc 5 and therefore is not transferred to the inner book 2. To adjust the zero-application position an adjusting nut 13 is tightened against a clevis 15 attached to the other end of the pin 8 via shim washers 14. In the zero-application position of the doctor blade 7 the adjusting nut 13 bears against a stop 12 attached to the respective block 16*a*, 16*b*.

To actuate a doctor blade 7 a contraction hose 24*a*, 24*b* which is activated by compressed air and contracts as a single-acting pull actuator is provided according to the invention. The respective contraction hose 24*a*, 24*b* is so arranged that it pulls the doctor blade from its zero-application position to an application position against the force of the compression spring 9. To achieve a compact construction the contraction hose 24*a*, 24*b* is arranged vertically beside the reservoir 4. Its pull motion is converted into a horizontal motion by means of a reversing lever 26. For this purpose the reversing lever 26 is pivoted in a respective mounting 20*a*, 20*b* and is connected on one side to the clevis 15 of the pin 8 and on the other to a clevis 25 attached to one end of the respective contraction hose 24*a*, 24*b*.

The second end of the contraction hose 24*a*, 24*b* is screwed into a right-angled bracket 23 while being connected to a compressed air line 28, a quick-action venting valve 27 being interposed. The bracket 23 also serves as a protection plate against heat radiated from the reservoir 4 when the latter is heated for processing hot-melt adhesive. To limit the pull travel of the contraction hose 24*a*, 24*b*, and therefore to define the application position of the doctor blade 7 for maximum adhesive application, a stop 21 is provided on the mounting 20*a*, 20*b*, against which an adjusting screw 22 fixed in the reversing lever 26 bears. Both stops 12 and 21 are made of hardwood and therefore have a damping effect.

The above-described means are combined into a unit for each application side of the side-gluing mechanism 1 by being associated with respective supports 18*a,b*. Thus, the associated application disc 5 is journalled in the support 18*b* for the right-hand application side, and the mounting 20*b* and the block 16*b* are attached thereto, the latter being removable from the side-gluing mechanism 1 by releasing the fixing screw 38. Fast access to the adhesive conveyor 6*a* is thereby made possible. Only the pivot connections of the clevis 15 and the reversing lever 26 must also be detached. When installing, the correct position is relocated via a stop plate 39. The right-hand unit is guided on a rod 19 and is adjusted by known means with respect to the inner book thickness D.

The activation of the contraction hoses 24*a,b* is effected separately for each application side by separate pneumatic valves 29, for example 3/2-way valves which are electromagnetically actuated to move to the two positions. The pneumatic valves 29 are connected to a compressed air supply 31, a precision pressure regulating valve 30 ensuring a constant pressure supply. The pressure for activating the contraction hoses 24*a,b* is so calculated that, in conjunction with the oppositely-acting compression springs 9, equal switching or movement times for the movement of the doctor plate 7 to the application position and to the zero-application position are achieved.

The spring 9 is thus preferably in compression during the "zero application" position of the doctor blade. The pressurization of the contraction hose overcomes the spring to open the gap between the doctor blade and the adhesive application wheel in the "application" position. Preferably, the gap is dynamically adjustable by dynamic control of the pressure applied to the contraction hose. In the illustrated embodiment, actuation of the doctor blade to produce a gap requires a "pulling down" force on the pivot at 15, which result from shortening (contraction) of the hose 24. The contraction hose is thus pressurized for actuation of the doctor blades. With pressurization the hose contracts in length while expanding in diameter. This type of contraction hose is available as the Fluidic Muscle MAS device from Festo AG & Co. KG (Esslingen-Berkeim, Germany, with offices in Hauppauge, N.Y.). It should be understood, however, that other forms of contraction hose could be equivalent to the Fluidic Muscle MAS device so long as they provide an equivalent essential characteristic.

The essential characteristic of a contraction hose 24*a,b* is its minimal lag upon activation. It does not exhibit slip-stick behaviour and in addition generates high-acceleration movements. The switching time is very short and is constant under practically all conditions. It can therefore be controlled as a calculable value by a programmable control unit 33, values for the pilot control of the pneumatic valves 29 being permanently predefinable. This control unit 33 determines the precise switching times for activating the corresponding positions of the pneumatic valves 29 via control lines 32 by means of the signals of a rotation sensor 35 connected to the drive shaft of the inner book transport system and through knowledge of the desired application positions.

The desired application positions are defined by the user in an overriding central control unit and are available to the control unit 33 via a control line 34. Manual adjustment is no longer required. In addition, application patterns in the manner of adhesive layers which are interrupted (as desired) can be produced. For example, the position of the separating saw cut in an inner book produced as a double copy can be allowed for, no adhesive being applied to this position. The cutting quality and performance of the separating saw are thereby increased. Through the separate activation of the two doctor blades 7 for each application side, with separate contraction hoses 24*a,b*, the adhesive layer pattern for both sides of the inner book can be selected differently, or one side receives no adhesive layer.

The above-described side-gluing mechanism 1 represents one embodiment of the device according to the invention. The spine-gluing mechanism 51 shown in FIG. 3, which is arranged behind the side-gluing mechanism 1 in adhesive binders, viewed in the transport direction T, and through which the inner book passes first, is an embodiment of similar type. As in the side-gluing mechanism 1, the adhesive is located in a reservoir 52 below the movement path of the inner book 2 and is fed from said reservoir 52 by means of application rollers 53*a,b* rotating in the transport direction T of the inner book 2. To meter the particular adhesive layer thicknesses on the two application rollers 53*a,b*, doctor blades 54*a,b* adjustable with respect to the cylindrical surfaces of the rollers are provided. A thin layer of adhesive is applied with the first application roller 53*a* and a thick layer of adhesive with the second application roller 53*b*. To level and remove surplus adhesive from the inner book spine 2*a* a spinner roller 55 rotating in the direction opposite to the transport direction T of the inner book 2 is arranged downstream of the two above-mentioned application rollers 53*a, b*.

Each doctor blade 54*a*, 54*b* is fixed exhangeably to a lever 57 via a mounting 57*a*. The lever is pressed against an adjustable stop 61 by a compression spring 59 which bears against a bracket 58, the zero-application position of the doctor blade 54*a*, 54*b* being determined thereby. A contraction hose 56*a*, 56*b*, which is pivoted to one end of the lever 57 via a clevis 62 and which pulls the doctor blade 54*a*, 54*b* to an application position, also acts on the lever 57. The contraction hose 56*a, 56b* is mounted in a bracket 63 and is activated via a compressed air line 69 having an interposed quick-action venting valve 64.

The maximum application thickness in the application position of the doctor blade 54*a*, 54*b* is adjustably limited by a stop, a stop plate 57*b* of the lever 57 moving against an eccentric 60. The eccentric 60 can be rotated by means of an adjusting shaft 60*a* driven from outside, in order to set the maximum application thickness. The contraction hoses 56*a,b* are activated in principle in the same manner as in the side-gluing mechanism 1. However, the present embodiment shows a variant whereby adhesive layers of differing thickness can be applied during an application of adhesive to an inner book 2. To this end the compressed-air activation of one contraction hose 56*a* is performed by two pneumatic valves 67*a* and 67*b*, the pneumatic valve 67*a* switching the compressed air on and off and the pneumatic valve 67*b* switching back and forth between two pressures, which are adjustable by means of the two pressure regulating valves 66*a,b*.

In this variant a further feature of the contraction hose 56*a* (56*b*, 24*a,b*) is exploited, namely its defined pull length, which is adjusted by charging with compressed air at a defined pressure. By varying the pressure of the compressed air controlling the respective contraction hose 56*a*, 56*b*, therefore, different application thicknesses can be set. In the spine-gluing mechanism 51 a selection can be made between two application thicknesses. The relief of the inner book spine 2*a* is traced before transit by means of a sensor 70 arranged behind the spine-gluing mechanism 51, viewed in the transport direction T, and communicated to the control unit 65 via the signal line 68. The latter controls the pneumatic valves 67*a,b* in such a way that e.g. channels or grooves in the inner book spine 2*a* are adequately filled with adhesive by means of a suitably deeper layer of adhesive.

Figure 3:
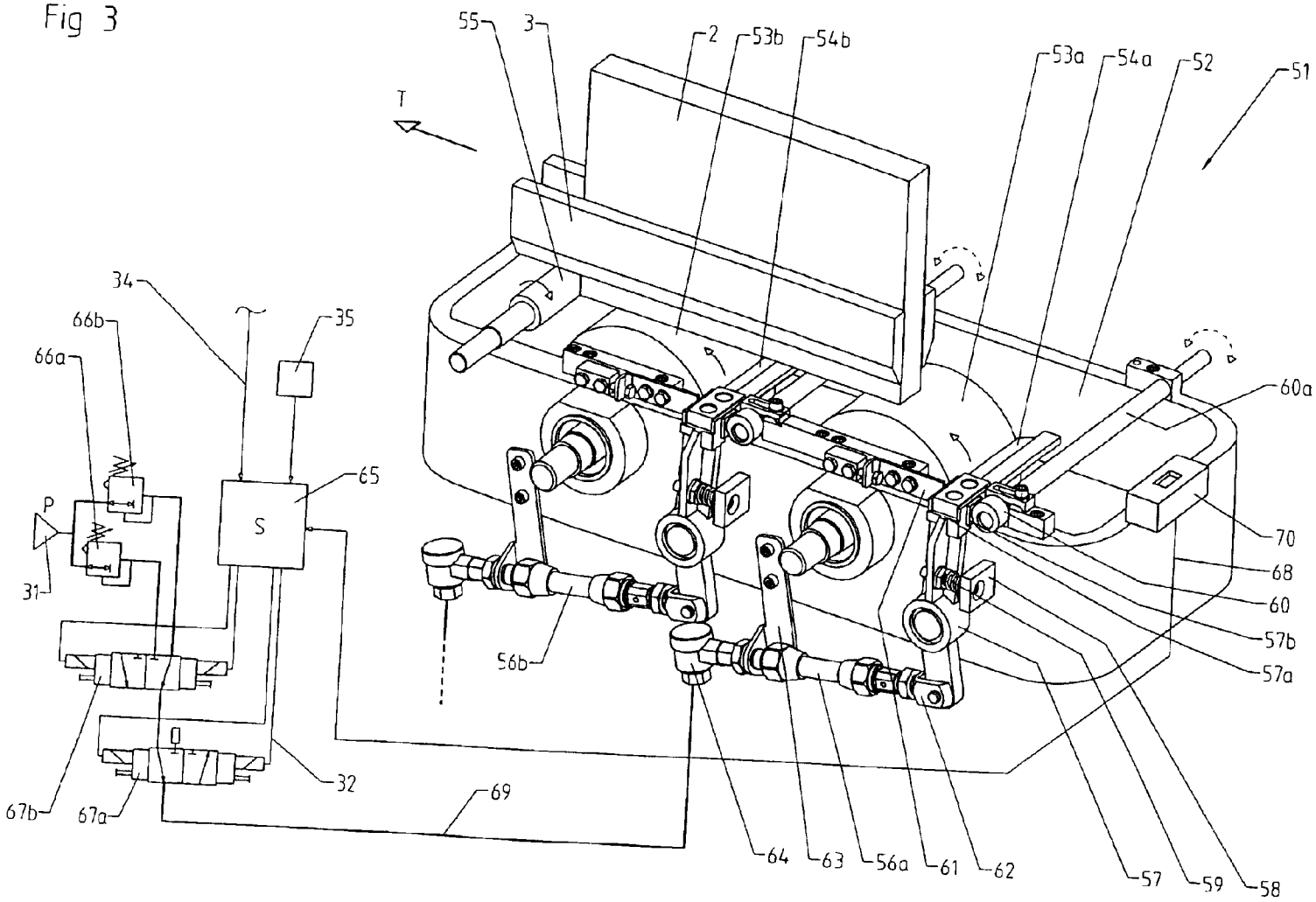
FIG. 3 shows a spine-gluing mechanism according to the invention in a perspective view.
Figure 4:
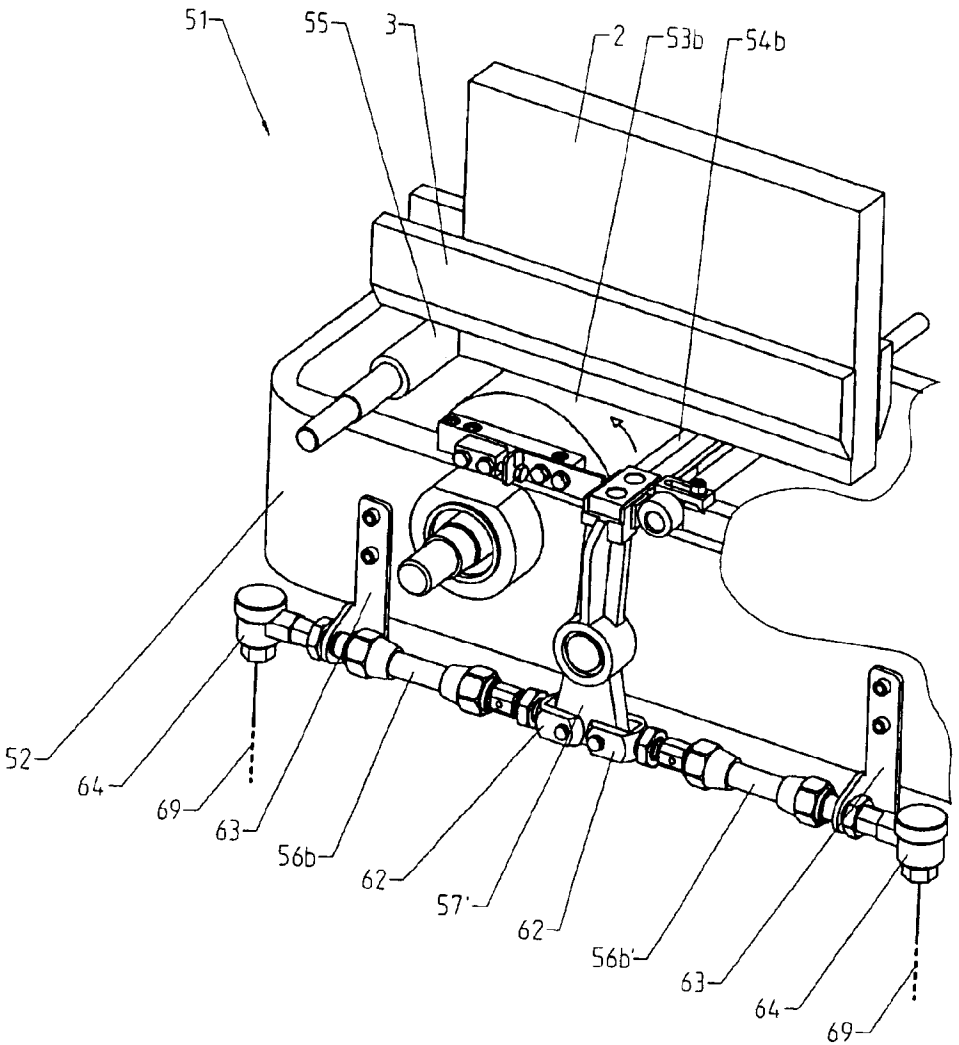
FIG. 4 shows another embodiment, wherein the actuation of the doctor blade is effectuated by two reciprocally acting contraction hoses, in the context of the spine-gluing mechanism.

FIG. 4 shows another embodiment, wherein the actuation of the doctor blade is effectuated by two reciprocally acting contraction hoses, in the context of the spine-gluing mechanism 51 of FIG. 3. The application roller and associated actuator corresponding to 53*a* of FIG. 3 have been omitted, whereas the reciprocally acting contraction hoses associated with application roller 53*b* are shown with numeric identifiers corresponding to functionally like parts in FIG. 3. Parts 56*b*' and 57' are the additional contraction hose and lever, respectively, needed for implementing this embodiment, whereby the hoses pull the doctor blade alternately to the application and the zero-application positions.

What is claimed is:

1. A device for applying an adhesive to a projectory spine region of an inner book while conveyed in a transport system comprising:

at least one rotating application wheel which picks up adhesive from a reservoir and transfers said adhesive to the inner book by rolling-off; a doctor blade confronting the wheel an adjustable distance for regulating the application thickness of the adhesive;

an actuating device for controlled movement of the doctor blade between an application position and a zero-application position, wherein the actuating device includes at least one contraction hose controllable via compressed air and functioning as a single-acting pull actuator.

2. Device according to claim 1, wherein the actuating device includes a spring for urging the doctor blade into one of said positions against which the actuation of the contraction hose operates.

3. Device according to claim 2, wherein the contraction hose and spring are arranged such that the contraction hose pulls the doctor blade into the application position when actuated by compressed air.

4. Device according to claim 1, wherein the actuating device includes two reciprocally-acting contraction hoses, which the doctor blade alternately to the application and the zero-application positions.

5. Device according to claim 1, including adjustable stops defining the application and zero-application positions of the doctor blade movement, wherein the stops are configured as dampers.

6. Device according to claim 1, wherein the book spine region has a front and a rear as conveyed and the pressure applied to the contraction hose is controlled by a pilot pneumatic valve as a function of the conveying velocity of the book, for achieving adhesive applications positioned precisely with respect to the front and rear of the book.

7. Device according to claim 1, wherein the pressure of the compressed air controlling the contraction hose is variable, whereby the associated doctor blade is pulled to a position between the zero-application and the application positions commensurate with said pressure.

8. Device according to claim 7, wherein the spine region has a relief surface and means are provided for applying an adhesive pattern complementary to the relief of the spine region by tracing the relief surface and delivering tracts to a control unit for the varying the compressed air control to the contraction hose.

9. Device according to claim 1, wherein a separate actuating device having at least one contraction hose, which can be activated separately, is provided for each doctor blade.

10. Device according to claim 1, wherein the device includes a side-gluing mechanism having an adhesive conveyor with associated adhesive scraper with the doctor blade guided therein, is configured to be removable by disconnecting an articulated joint between the contraction hose and the doctor blade.

11. Device according to claim 1, wherein the device includes a side-gluing mechanism and the contraction hose or hoses are arranged vertically beside the reservoir and the pulling of the hoses are transmitted to the doctor blade by reversing levers.

12. Device according to claim 11, wherein the contraction hose is protected against heat radiation from the reservoir by a cover plate.

13. Device according to claim 2, wherein the actuating device includes two reciprocally-acting contraction hoses, which the doctor blade alternately to the application and the zero-application positions.

14. Device according to claim 2, wherein adjustable stops defining the application and zero-application positions of the doctor blade movement, wherein the stops are configured as dampers.

15. Device according to claim 2, wherein the book spine region has a front and a rear as conveyed and the pressure applied to the contraction hose is controlled by a pilot pneumatic valve as a function of the conveying velocity of the book, for achieving adhesive applications positioned precisely with respect to the front and rear of the book.

16. Device according to claim 2, wherein the pressure of the compressed air controlling the contraction hose is variable, whereby the associated doctor blade is pulled to a position between the zero-application and the application positions commensurate with said pressure.

17. Device according to claim 4, wherein adjustable stops defining the application and zero-application positions of the doctor blade movement, wherein the stops are configured as dampers.

18. Device according to claim 4, wherein the book spine region has a front and a rear as conveyed and the pressure applied to the contraction hose is controlled by a pilot pneumatic valve as a function of the conveying velocity of the book, for achieving adhesive applications positioned precisely with respect to the front and rear of the book.

19. Device according to claim 4, wherein the pressure of the compressed air controlling the contraction hose is variable, whereby the associated doctor blade is pulled to a position between the zero-application and the application positions commensurate with said pressure.

20. Device according to claim 4, wherein the spine region has a relief surface and means are provided for applying an adhesive pattern complementary to the relief of the spine region by tracing the relief surface and delivering the tracts to a control unit for the varying the compressed air control to the contraction hose.

* * * * *